US012637817B2

(12) United States Patent
Schmidt et al.

(10) Patent No.: US 12,637,817 B2
(45) Date of Patent: May 26, 2026

(54) CURB BROOM DEVICE

(71) Applicants: Erich Schmidt, Sioux Falls, SD (US); Ryan Merrill, Canistota, SD (US)

(72) Inventors: Erich Schmidt, Sioux Falls, SD (US); Ryan Merrill, Canistota, SD (US)

( * ) Notice: Subject to any disclaimer, the term of this patent is extended or adjusted under 35 U.S.C. 154(b) by 557 days.

(21) Appl. No.: 17/964,865

(22) Filed: Oct. 12, 2022

(65) Prior Publication Data

US 2024/0125064 A1 Apr. 18, 2024

(51) Int. Cl.
*E01H 1/05* (2006.01)

(52) U.S. Cl.
CPC ..... *E01H 1/056* (2013.01)

(58) Field of Classification Search
CPC .. E01H 1/056; E01H 1/00; E01H 1/02; E01H 1/05; E01H 1/053; E01H 1/003; E01H 5/06; E01H 5/061; E01H 5/062; E01H 5/063; E01H 5/067
See application file for complete search history.

(56) References Cited

U.S. PATENT DOCUMENTS

| | | | | |
|---|---|---|---|---|
| 2,242,472 | A * | 5/1941 | Keeler | E01H 5/06 37/234 |
| 6,622,336 | B2 | 9/2003 | Jackson | |
| 9,422,682 | B2 | 8/2016 | Faught, Jr. | |
| 2005/0102778 | A1* | 5/2005 | Gregerson | E02F 3/3414 15/82 |
| 2021/0292980 | A1* | 9/2021 | Smith | B08B 1/34 |

FOREIGN PATENT DOCUMENTS

| | | |
|---|---|---|
| CN | 205776012 | 6/2016 |
| CN | 107338751 | 7/2017 |
| CN | 207739197 | 8/2017 |
| CN | 211430504 | 12/2019 |
| WO | WO2010018271 | 8/2008 |

* cited by examiner

*Primary Examiner* — Andrew A Horton
(74) *Attorney, Agent, or Firm* — Jeffrey A. Proehl, Woods Fuller Shultz & Smith

(57) ABSTRACT

A curb brush device for sweeping a newly formed curb includes a frame for attachment to a vehicle such that the frame extends forwardly from the vehicle. The frame includes a frame attachment bracket and a rail coupled to the frame attachment bracket. A brush arm is coupled to the rail and is extendable laterally from the rail. A brush is coupled to the brush arm. The brush is rotatable for sweeping a surface laterally offset from the vehicle.

21 Claims, 6 Drawing Sheets

CURB BROOM DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to brush devices and more particularly pertains to a new brush device for sweeping a newly formed curb.

(2) Description of Related Art Including Information Disclosed Under 37 CFR 1.97 and 1.98

The prior art relates to brush devices. Known prior art lacks an offset and elevated brush to allow a conventional skidsteer or similar vehicle to sweep and clear debris from a newly formed curb.

BRIEF SUMMARY OF THE INVENTION

An embodiment of the disclosure meets the needs presented above by generally comprising a frame for attachment to a vehicle such that the frame extends forwardly from the vehicle. The frame includes a frame attachment bracket and a rail coupled to the frame attachment bracket. A brush arm is coupled to the rail and is extendable laterally from the rail. A brush is coupled to the brush arm. The brush is rotatable for sweeping a surface laterally offset from the vehicle.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
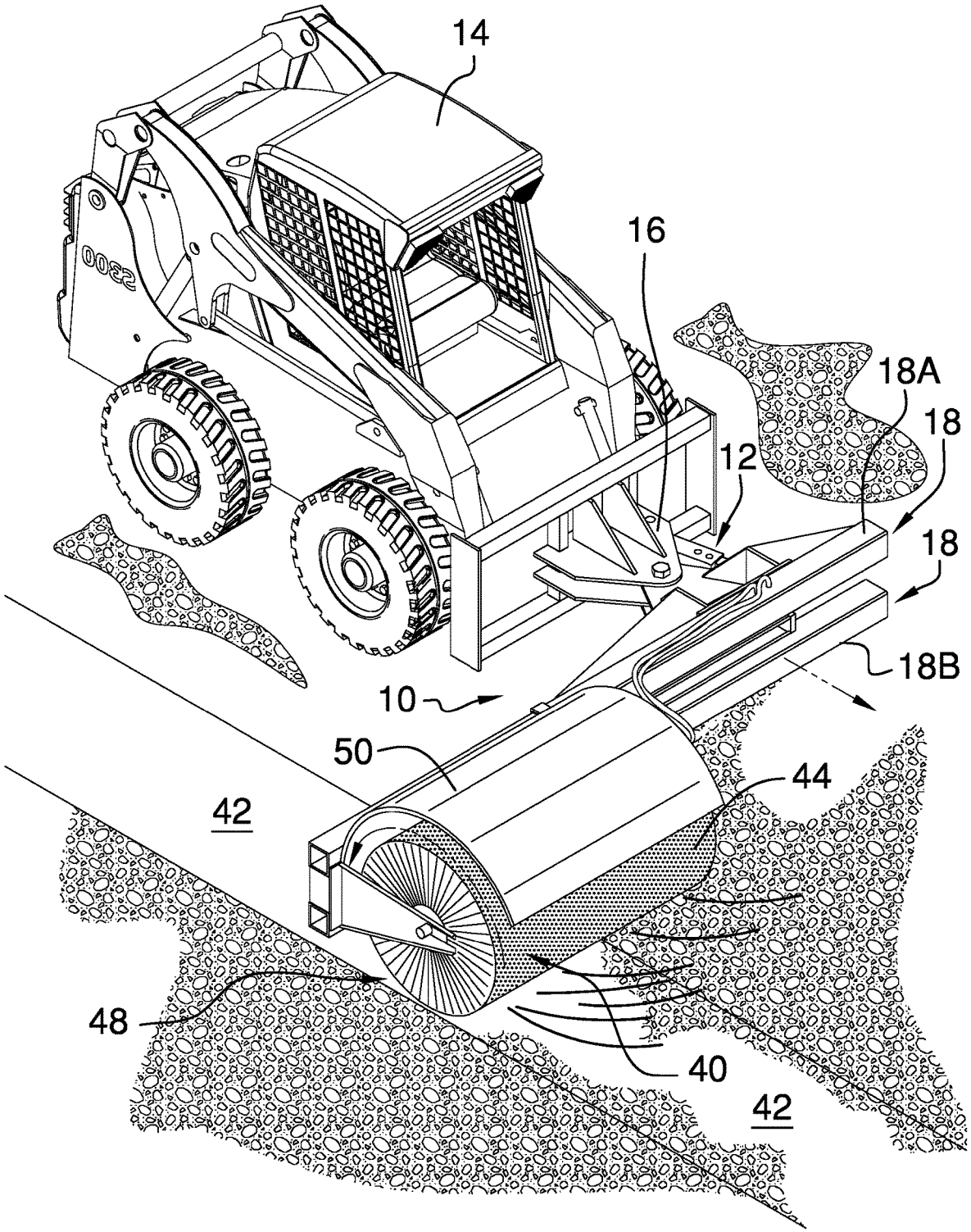
FIG. 1 is a top front side perspective view of a curb brush device according to an embodiment of the disclosure in use.
Figure 2:
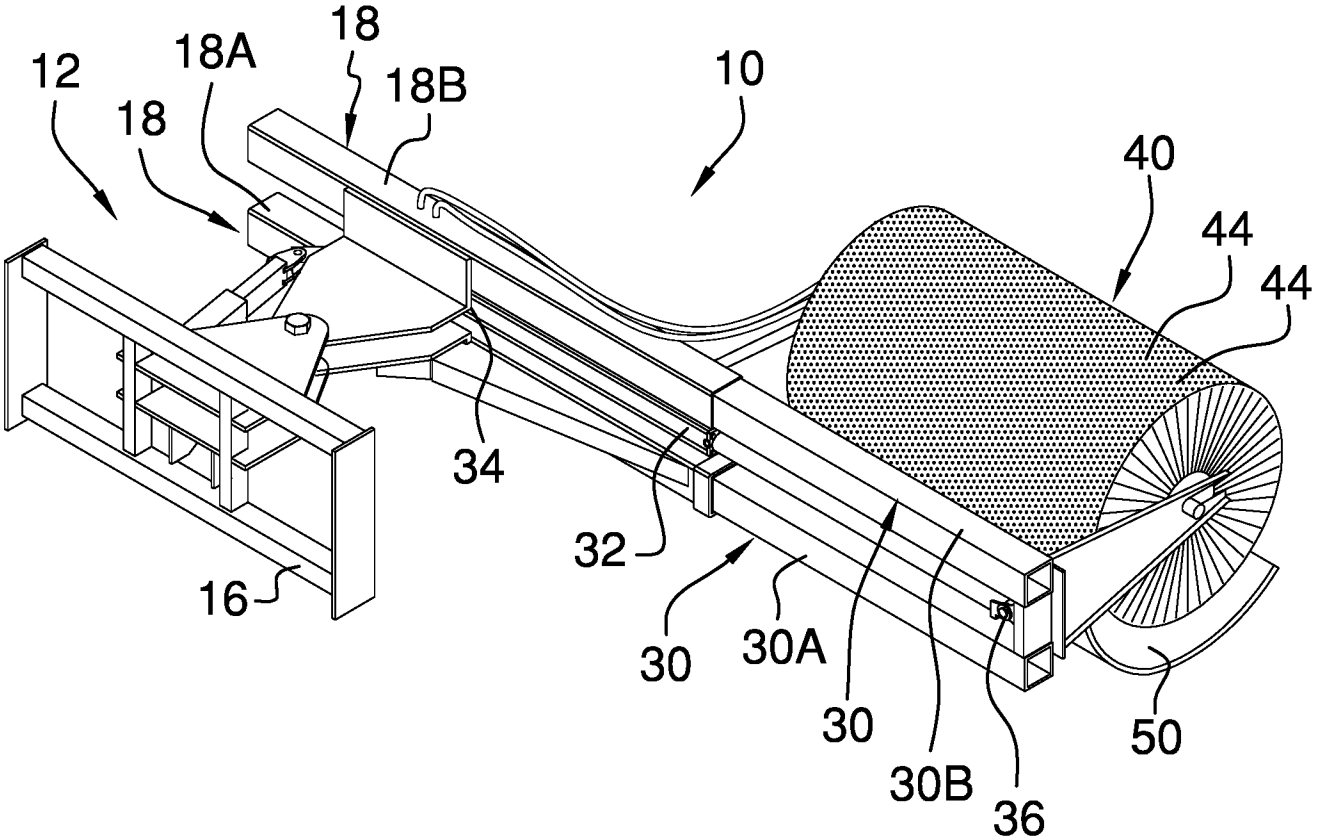
FIG. 2 is a bottom rear side perspective view of an embodiment of the disclosure.
Figure 3:
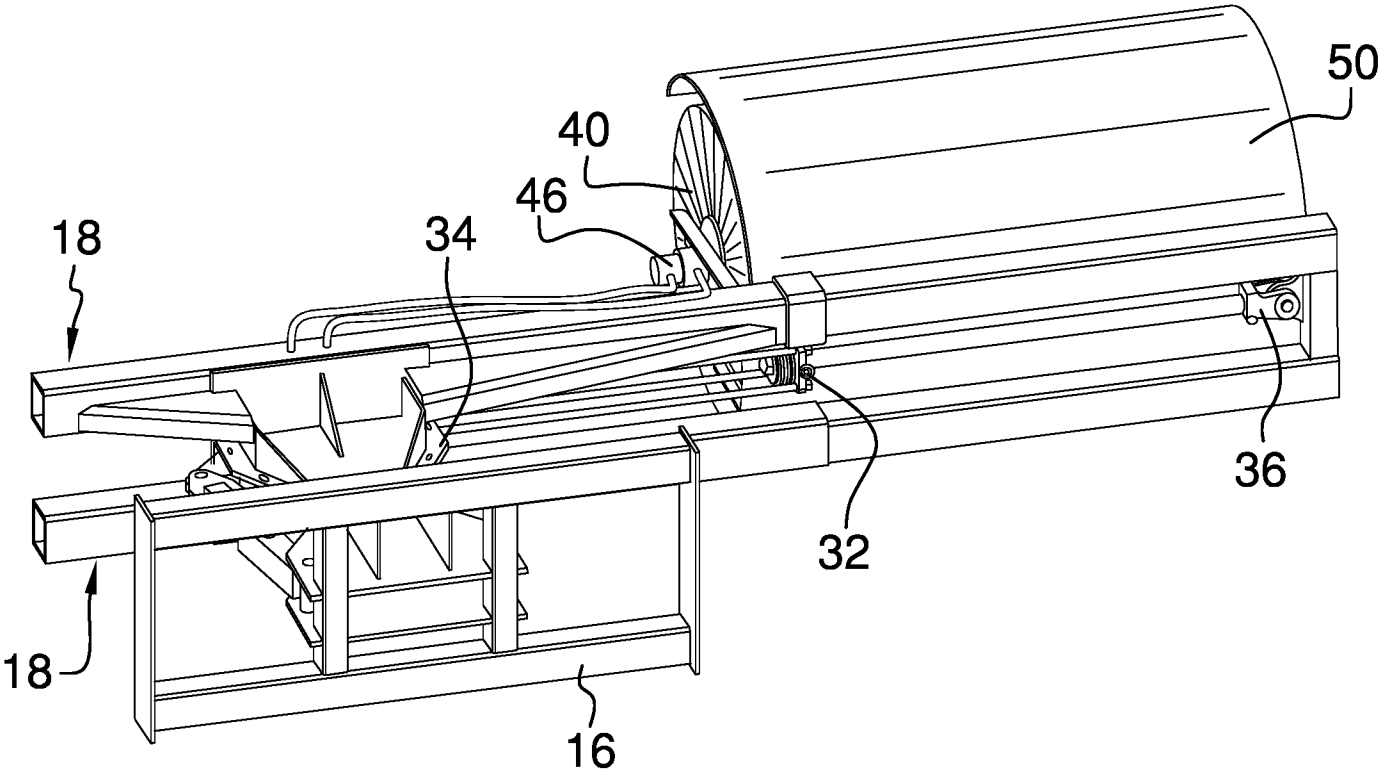
FIG. 3 is a top rear side perspective view of an embodiment of the disclosure.
Figure 4:
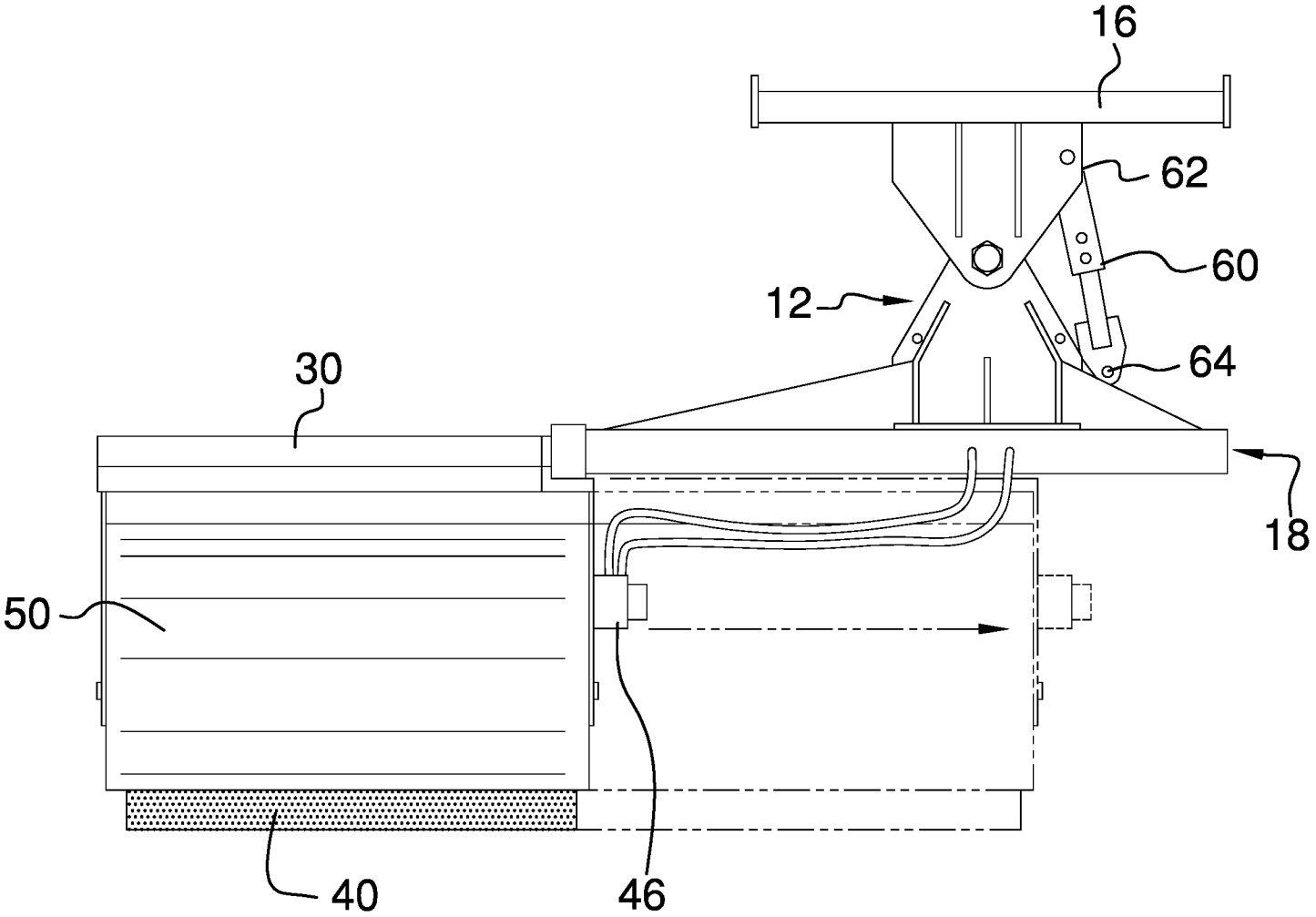
FIG. 4 is a top view of an embodiment of the disclosure.
Figure 5:
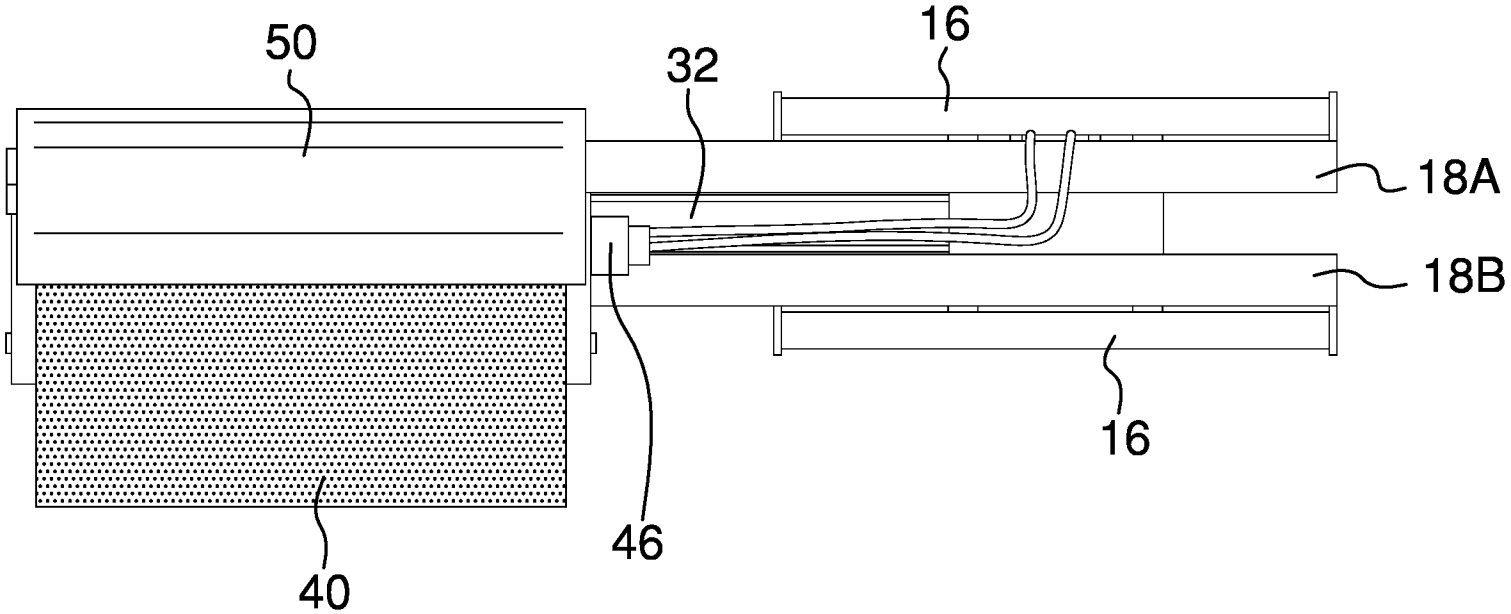
FIG. 5 is a front view of an embodiment of the disclosure.
Figure 6:
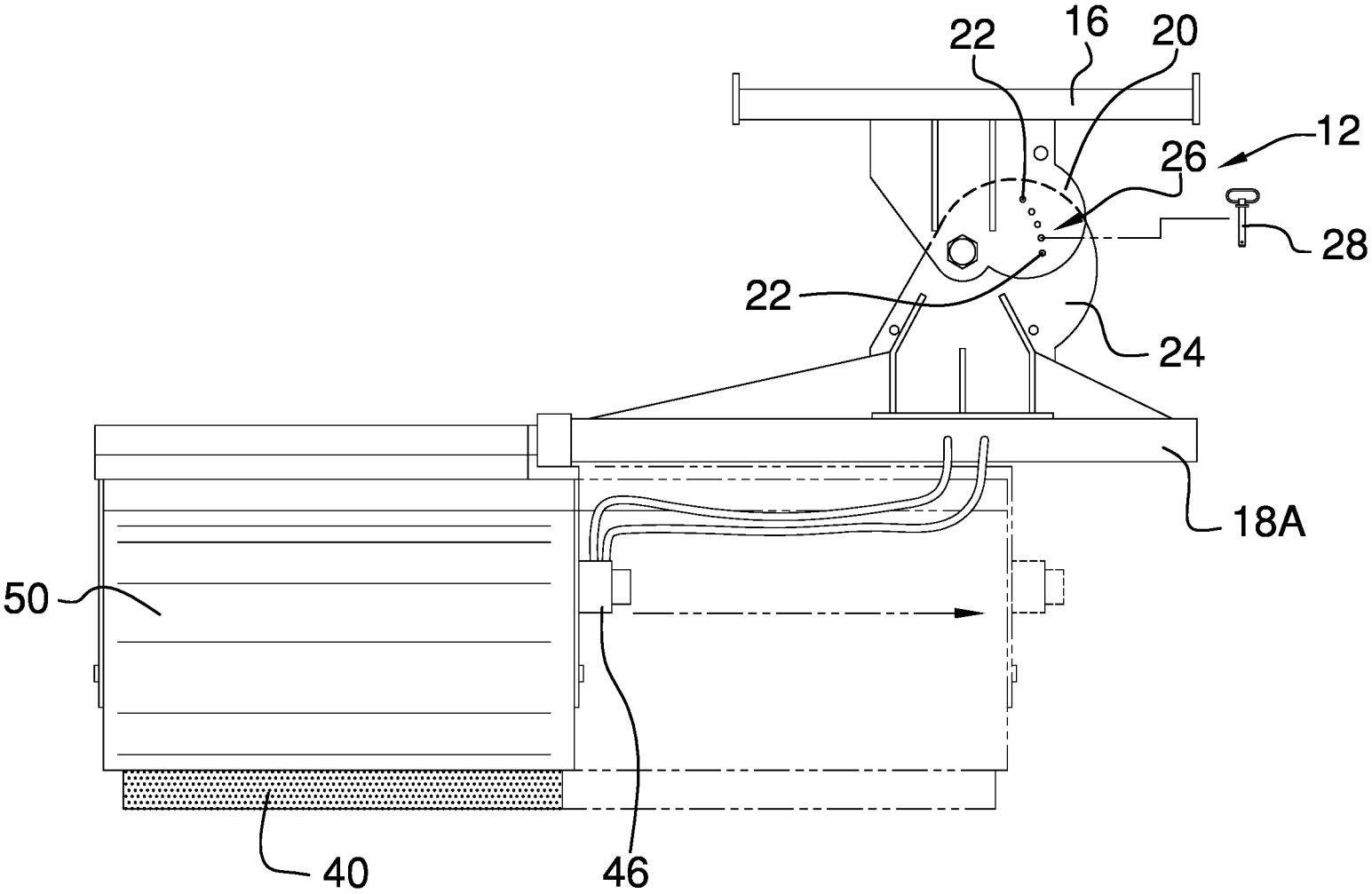
FIG. 6 is a top view of an embodiment of the disclosure.

With reference now to the drawings, and in particular to FIGS. 1 through 6 thereof, a new brush device embodying the principles and concepts of an embodiment of the disclosure and generally designated by the reference numeral 10 will be described.

As best illustrated in FIGS. 1 through 6, the curb brush device 10 generally comprises a frame 12. The frame 12 is configured for attachment to a vehicle 14 such that the frame 12 extends forwardly from the vehicle 14. The manner of attachment is conventional and known for attaching other accessories such as plows and the like. The frame 12 includes a frame attachment bracket 16 and a rail 18 coupled to the frame attachment bracket 16. The rail 18 is pivotally coupled to the frame attachment bracket 16 to allow the rail 18 to be positioned at a desired angle relative to the frame attachment bracket 16. A bracket plate 20 may be coupled to the frame attachment bracket 16. The bracket plate 20 has a plurality of bracket plate holes 22. The bracket plate holes 22 are radially arranged about a pivot point between the frame attachment bracket 16 and the rail 18. A rail plate 24 is coupled to the rail 16 and is overlapped with the bracket plate 20. The rail plate 24 has an aperture 26 positionable to align with a selectable one of the bracket plate holes 22. A pin 28 is insertable through the selectable one of the bracket holes 22 and the aperture 26 wherein the pin 28 inhibits pivoting of the rail 18 relative to the frame attachment bracket 16. Alternatively, a pivot ram 60 has a first end 62 coupled to the frame attachment bracket 16 and a second end 64 coupled to the rail 18 wherein extension and retraction of the pivot ram 60 adjusts an angle between the frame attachment bracket 16 and the rail 18. The pivot ram 60 is hydraulic and configured for hydraulic coupling to the hydraulic system of the vehicle 14 so that the pivot ram 60 can be controlled conventionally using a connection to a hydraulic system of the vehicle 14.

A brush arm 30 is coupled to the rail 18. The brush arm 30 extends laterally from the rail 18. The brush arm 30 is adjustably extendable from the rail 18. An extension ram 32 has a primary end 34 coupled to the rail 18 and a secondary end 36 coupled to the brush arm 30. Extension and retraction of the extension ram 32 adjusts a length of extension of the brush arm 30 from the rail 18. The extension ram 32 is hydraulic and configured for hydraulic coupling to the hydraulic system of the vehicle 14.

A brush 40 is coupled to the brush arm 30. The brush 40 is rotatable wherein the brush 40 is configured for sweeping a surface 42 laterally offset from the vehicle 14. The brush 40 is cylindrical and includes a plurality of bristles 44 arranged and extending radially relative to a central axis of the brush 40. The plurality of bristles 44 is flexible wherein the brush 40 is configured for conforming to a shape of a curb formed by the surface 42 laterally offset from the vehicle 14. A motor 46 is coupled to the frame 12. The motor 46 is operationally coupled to the brush 40 wherein the motor 46 rotates the brush 40. The motor 46 is hydraulic and configured for hydraulic coupling to the hydraulic system of the vehicle 14 using conventional hydraulic lines as are commonly known and used for control of other types of accessories such as a plow or the like. The brush 40 is rotated by the motor 46 such that a bottom 48 of the brush 40 moves in a forward direction on the surface 42 laterally offset from the vehicle 14. This drives debris on the surface 42 forward leaving the surface clear of dirt and debris as the brush 40 passes over the surface 42 in a forward direction. A cover 50 is coupled to the brush arm 30. The cover 50 is arcuate such that the cover 50 is positioned concentric with respect to the brush 40. The cover 50 extends upwardly and forwardly from the brush arm 30 wherein the cover 50 extends from the brush arm 30 over a top of the brush 40.

The rail 18 may be one of a pair of rails 18A,18B. The pair of rails 18A,18B is parallel and horizontally oriented. The brush arm 30 may similarly be one of a pair of brush arms 30A,30B. Each brush arm 30 of the pair of brush arms 30A,30B is coupled to and extendable from a respective rail of the pair of rails 18A,18B.

In use, the frame 12 is attached to the vehicle 14 and any hydraulic connections are made to the hydraulic system of the vehicle 14. The brush 40 is extended laterally from the rail 18 and the vehicle 14. The brush 40 is rotated by the motor 46 and the vehicle 14 is driven to pass the brush 40 over the surface 42.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A curb brush device for use with a vehicle having a forward movement direction, the curb brush device comprising:

a frame configured for attachment to the vehicle such that said frame is positioned forwardly of the vehicle, said frame including a frame attachment bracket and a rail pivotally coupled to said frame attachment bracket such that said rail pivots with respect to said attachment bracket about a vertical axis when said frame is mounted on the vehicle for use;

a brush arm coupled to said rail, said brush arm extending in a lateral direction with respect to the forward movement direction of the vehicle, said brush arm being extendable and retractable with respect to said rail along a lateral movement axis; and a brush coupled to said brush arm, said brush being rotatable wherein said brush is configured for sweeping a surface laterally offset from the vehicle.

2. The curb brush device of claim 1, further comprising said brush being cylindrical, said brush including a plurality of bristles arranged and extending radially relative to a central axis of said brush.

3. The curb brush device of claim 2, further comprising said plurality of bristles being flexible wherein said brush is configured for conforming to a shape of a curb formed by the surface laterally offset from the vehicle.

4. The curb brush device of claim 1, further comprising a motor coupled to said frame, said motor being operationally coupled to said brush wherein said motor rotates said brush.

5. The curb brush device of claim 4, further comprising said motor being hydraulic.

6. The curb brush device of claim 1 wherein the lateral movement axis of the brush arm is horizontally oriented.

7. The curb brush device of claim 6, further comprising a pivot ram, said pivot ram having a first end coupled to said frame attachment bracket, said pivot ram having a second end coupled to said rail wherein extension and retraction of said pivot ram adjusts an angle between said frame attachment bracket and said rail, said pivot ram being hydraulic.

8. The curb brush device of claim 1, further comprising an extension ram, said extension ram having a primary end coupled to said rail, said extension ram having a secondary end coupled to said arm wherein extension and retraction of said extension ram adjusts a length of extension of the arm from the rail.

9. The curb brush device of claim 8, further comprising said extension ram being hydraulic.

10. The curb brush device of claim 1 wherein said brush arm moves along a lateral movement path extending along the lateral movement axis such that said brush is movable from a first position in front of said attachment bracket to a second position offset in the lateral direction from in front of said attachment bracket.

11. The curb brush device of claim 1, further comprising said brush being rotated such that a bottom of said brush is configured to move in a forward direction on the surface laterally offset from the vehicle.

12. The curb brush device of claim 1, further comprising a cover coupled to said brush arm, said cover being arcuate such that said cover is positioned concentric with respect to said brush.

13. The curb brush device of claim 12, further comprising said cover extending upwardly and forwardly from said arm wherein said cover extends from said arm over a top of said brush.

14. The curb brush device of claim 1, further comprising said rail being one of a pair of rails, said pair of rails being parallel and horizontally oriented.

15. The curb brush device of claim 14, further comprising said brush arm being one of a pair of brush arms, each brush arm of said pair of brush arms being coupled to and extendable from a respective rail of said pair of rails.

16. The curb brush device of claim 1 wherein said brush arm is telescopically extendable from said rail.

17. The curb brush device of claim 1 wherein said brush is configured to rotate about a rotational axis; and wherein the rotational axis of said brush is oriented parallel to the lateral movement axis of said brush arm.

18. A curb brush device comprising:

a frame, said frame being configured for attachment to a vehicle such that said frame extends forwardly from the vehicle, said frame including a frame attachment bracket and a rail coupled to said frame attachment bracket, said rail being pivotally coupled to said frame attachment bracket;

a brush arm coupled to said rail, said brush arm extending laterally from said rail, said brush arm being adjustably extendable from said rail;

a brush, said brush being coupled to said brush arm, said brush being rotatable wherein said brush is configured for sweeping a surface laterally offset from the vehicle, said brush being cylindrical, said brush including a plurality of bristles arranged and extending radially relative to a central axis of said brush, said plurality of bristles being flexible wherein said brush is configured for conforming to a shape of a curb formed by the surface laterally offset from the vehicle;

a motor coupled to said frame, said motor being operationally coupled to said brush wherein said motor rotates said brush, said motor being hydraulic, said brush being rotated by said motor such that a bottom of said brush is configured to move in a forward direction on the surface laterally offset from the vehicle;

an extension ram, said extension ram having a primary end coupled to said rail, said pivot ram having a secondary end coupled to said brush arm wherein extension and retraction of said extension ram adjusts a length of extension of the brush arm from the rail, said extension ram being hydraulic;

a cover coupled to said brush arm, said cover being arcuate such that said cover is positioned concentric with respect to said brush, said cover extending upwardly and forwardly from said brush arm wherein said cover extends from said brush arm over a top of said brush; and said rail being one of a pair of rails, said pair of rails being parallel and horizontally oriented, said brush arm being one of a pair of brush arms, each brush arm of said pair of brush arms being coupled to and extendable from a respective rail of said pair of rails.

19. The curb brush device of claim 18, further comprising a pivot ram, said pivot ram having a first end coupled to said frame attachment bracket, said pivot ram having a second end coupled to one rail of said pair of rails wherein extension and retraction of said pivot ram adjusts an angle between said frame attachment bracket and said rail, said pivot ram being hydraulic.

20. The curb brush device of claim 18, further comprising:

a bracket plate coupled to said frame attachment bracket, said bracket plate having a plurality of bracket plate holes, said bracket plate holes being radially arranged about a pivot point between said frame attachment bracket and said rail;

a rail plate coupled to one rail of said pair of rails, said rail plate having an aperture positionable to align with a selectable one of said bracket plate holes; and a pin insertable through said selectable one of said bracket holes and said aperture wherein said pin inhibits pivoting of said rail relative to said frame attachment bracket.

21. A curb brush device for use with a vehicle having a forward movement direction, the curb brush device comprising:

a frame configured for attachment to the vehicle such that said frame is positioned forwardly of the vehicle, said frame including a frame attachment bracket and a rail pivotally coupled to said frame attachment bracket such that said rail pivots with respect to said attachment bracket about a vertical axis when said frame is mounted on the vehicle for use;

a brush arm coupled to said rail, said brush arm extending in a lateral direction with respect to the forward movement direction of the vehicle, said brush arm being extendable and retractable with respect to said rail along a lateral movement axis; and a brush coupled to said brush arm, said brush being rotatable wherein said brush is configured for sweeping a surface laterally offset from the vehicle;

wherein said brush is configured for sweeping a surface forward of the vehicle when said brush arm is retracted and sweeping a surface laterally offset from the vehicle when said brush arm is extended.

* * * * *